United States Patent [19]

Yu et al.

[11] 4,316,786

[45] Feb. 23, 1982

[54] APPARATUS FOR ELECTROPLATING PARTICLES OF SMALL DIMENSION

[75] Inventors: Conrad M. Yu, San Lorenzo; John D. Illige, Fremont, both of Calif.

[73] Assignee: The United States of America as represented by the United States Department of Energy, Washington, D.C.

[21] Appl. No.: 188,791

[22] Filed: Sep. 19, 1980

[51] Int. Cl.[3] ..... C25D 17/16; C25D 21/10; C25D 21/12

[52] U.S. Cl. ..... 204/223; 204/20; 204/273; 204/275

[58] Field of Search ..... 204/222, 223, 23, 25, 204/20, 273, 275

[56] References Cited

U.S. PATENT DOCUMENTS

| | | | |
|---|---|---|---|
| 2,744,860 | 5/1956 | Rines | 204/222 |
| 3,397,126 | 8/1968 | Gilbert | 204/23 |
| 3,577,324 | 5/1971 | Patterson | 204/20 |
| 3,779,873 | 12/1973 | Dewar | 204/222 |
| 3,994,796 | 11/1976 | Mayer | 204/223 |
| 4,046,643 | 9/1977 | Rippere | 204/223 |

*Primary Examiner*—T. Tufariello

*Attorney, Agent, or Firm*—L. E. Carnahan; Roger S. Gaither; Richard G. Besha

[57] ABSTRACT

The thickness, uniformity, and surface smoothness requirements for surface coatings of glass microspheres for use as targets for laser fusion research are critical. Because of their minute size, the microspheres are difficult to manipulate and control in electroplating systems. The electroplating apparatus (10) of the present invention addresses these problems by providing a cathode cell (20) having a cell chamber (22), a cathode (23) and an anode (26) electrically isolated from each other and connected to an electrical power source (24). During the plating process, the cathode (23) is controllably vibrated along with solution pulse to maintain the particles in random free motion so as to attain the desired properties.

22 Claims, 2 Drawing Figures

APPARATUS FOR ELECTROPLATING PARTICLES OF SMALL DIMENSION

The U.S. Government has rights in this invention pursuant to a Contract No. W-7405-ENG-48 between the U.S. Department of Energy and the University of California.

BACKGROUND OF THE INVENTION

The present invention relates generally to electroplating and, more particularly, to an apparatus for electroplating particles of small dimension .

The ever-increasing energy demands of the world, coupled with the threat of imminent total depletion of the earth's fossil fuel reserves, have lead to active studies of alternate sources of energy and research into developing systems and hardware for converting this energy into useful power. By way of example, solar panels have been developed which convert the radiation of the sun into heating for buildings, and the energy released by nuclear fission reactions has found application in the generation of steam and electrical power.

Controlled thermonuclear fusion reactions are yet another potential source of energy. This source is particularly attractive in that it shows promise of being almost limitless because of the naturally occurring abundance of certain fuel elements which have been successfully fused in laboratory experiments. One fusion method, which is properly called inertial confinement fusion, is a process whereby thermonuclear energy is generated when an intensely hot plasma of heavy hydrogen isotopes is inertially confined long enough for the nuclei to fuse or attain thermonuclear burn.

Initially the best fuels for inertial confinement fusion are the heavy isotopes of hydrogen called deuterium(D) and tritium(T). When deuterium tritium nuclei fuse, some of the mass of the original nuclear particles is transformed into energy. The result is a helium nucleus and an energetic (14.3 Mev) free neutron. These nuclear particles are formed with tremendous kinetic energies corresponding to the total energy released by the fusion reaction. The energetic fusion products may be harnessed to generate electrical power.

Two conditions are required to have efficient thermonuclear burn. First, thermonuclear ignition temperatures must be reached, approximately $10^8$°K. for deuterium and tritium. At these temperatures, the fuel matter becomes a swirling cloud of plasma and the thermal velocities of the nuclei are high enough to overcome the coulomb barrier during collision, which allows them to fuse. Secondly, the plasma must be confined long enough and at a high enough density for a significant portion of the nuclei to fuse "burn". At higher densities, the rate of burning increases and the required confinement time decreases, because the distance between nuclei is smaller and the probability of collisions is larger.

Thermonuclear ignition may be achieved by impacting a fuel pellet or target with an intense, high energy beam such as generated, for example, by a laser. Typically, laser fusion targets are minute, hollow glass micropheres having diameters on the order of 80 to 100 microns ($10^{-6}$ meter), which are filled with deuterium-tritium (DT) fuel mixture.

The mechanism for accomplishing the ignition is by a spherical implosion and is based upon Newton's Third Law that for every action there is an equal and opposite reaction. The laser energy interacts with the outer surface of the microsphere causing violent ablation thereof. The ablation of the target surface produces high pressures which accelerate the remainder of the target and the fuel at the core inward toward the center of the microsphere, thereby compressing it.

Compression of the D-T fuel mixture, to as much as $10^3$-$10^4$ times the liquid density of the fuel mixture, requires relatively little energy—approximately 1% of ignition energy—provided the fuel is kept relatively cool during compression. Therefore, a significant increase in process efficiency may be realized by delaying ignition of the fuel until the rapidly moving inner region of the mixture is suddenly braked by the pressure generated in the highly compressed matter, which, in turn, heats the fuel to the ignition point.

To this end, it is advantageous to coat the surface of the glass microspheres or targets with a material having a relatively high mass and density to absorb energetic electrons and x-rays released by the laser-target interaction and thereby shield the D-T fuel mixture from premature heating. Materials known as "high-Z" materials, indicating their position on the lower portion of the periodic table, have proven satisfactory for preheat shielding. More particularly, coatings of metals such as gold, copper, nickel, platinum, and uranium appear advantageous. Moreover, in addition to acting as a preheat shield, these coatings also serve as an implosion—velocity multiplier by colliding with the glass substrate during the implosion process.

There are several methods of coating glass microspheres, including electroplating, electroless plating, chemical vapor deposition, and physical vapor deposition techniques such as sputtering. Electroplating offers many advantages over the other methods, which are more complex and more limited. For example, chemical and vapor deposition processes are inapplicable, because they heat the glass shells and drive the D-T fuel mixture out.

Furthermore, since most efficient burn occurs when the fuel is compressed into a sphere, symmetry of the target implosion is critical. Therefore, any outer coating on the target must be of uniform thickness and must be smooth and uniform to within approximately 100 nm to avoid fluid instabilities which would interfere with fuel compression.

In conventional electroplating of the tiny glass microspheres, a conductive workpiece forms a cathode which is immersed in a plating solution. An initial conductive surface called a "strike" is produced by sputtering a layer of platinum having a thickness of approximately $1\text{-}3\times10^3$ Angstroms onto the surface of the nonconductive glass target spheres or by the deposition of silver thereon from an ammonical silver nitrate solution. Where the conductive microspheres with their strikes come in contact with the cathode in an electroplating cell, plating of the spheres occurs. However, unless the particles are kept in random free motion with only momentary contact with the cathode, a non-uniform coating will result, and the microspheres may even be plated to the cathode.

The problem of uniformly electroplating small parts has been addressed in U.S. Pat. No. 3,397,126 issued to F. N. Gilbert, Aug. 13, 1968. However, the system disclosed by Gilbert is unsatisfactory for the plating of initially buoyant parts, such as the glass microspheres, or those which, because of the mass of the plated material, change density with respect to the plating solution.

A process of electroplating particles with metals disclosed in U.S. Pat. No. 3,577,324 issued to J. A. Patterson, May 4, 1971 addresses the aforementioned problems by providing an apparatus wherein vibrating screens in an electroplating cell impart vibration to the plating solution to strip gaseous by-products from the particles to prevent the deposition of non-uniform surface coatings thereon. However, it has been found that in the electroplating of the glass microspheres, vibration of the solution alone or in concert with solution flow is insufficient to provide free and random motion and efficient gas scavenging of the particles. Such a system in particular fails when the difference between the density of the workpiece and the plating solution is large (as in the case of hollow glass microspheres) or when the mass of the particles is very small.

The foregoing illustrates limitations to the known prior art. Thus, it is apparent that it would be advantageous to provide an alternative to the prior art.

SUMMARY OF THE INVENTION

It is, therefore, an object of this invention to improve electroplating apparatus.

Another object of this invention is to improve apparatus for electroplating particles of small dimension.

A further object of this invention is to electroplate a coating of controlled, uniform thickness and surface smoothness onto particles of small dimension.

Still another object of this invention is to electroplate a coating of controlled uniform thickness and surface smoothness onto particles of small mass.

Yet another object of this invention is to impart free and random motion to particles of small dimension being electroplated.

Another object of this invention is to provide efficient gas scavenging of particles of small dimension being electroplated.

A further object of this invention is to electroplate a coating of controlled, uniform thickness and surface smoothness onto particles where the difference between the densities of the particles and the plating solution is large.

Additional objects, advantages, and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

These and other objects are attained in accordance with the present invention wherein there is provided an apparatus for electroplating particles of small dimension including a plating solution reservoir and pump, an electrical power source, a cathode cell for containing the particles and the plating solution during the plating process, a cathode, an anode electrically isolated from the cathode, both the cathode and the anode being connected to the power source establishing a reducing potential therebetween, and a vibrator for controllably vibrating the cathode to maintain the particles in random free motion.

Although electroplating has produced excellent uniformity and mirror surface finishes in many industrial applications, there are several recurrent problems which have constrained its use in the fabrication of laser fusion targets. Most targets have dimensions measusred in microns ($10^{-6}$meter), and consequently, manipulation and control of the targets during coating is difficult. Targets must also meet very high standards of surface smoothness and concentricity. Additionally, since glass microspheres or balloons have provided the high quality D-T fuel container upon which current target designs are based, the nonconductive glass surface must be coated with an electrically conductive layer or strike in order to electroplate. The microsphere with its strike must also be maintained in constant random motion during its contact with the cathode to prevent adherence thereto and deposition of a nonuniform coating.

The present invention advantageously overcomes these and other associated problems by providing a cathode cell having a resilient cathode disposed in a cell chamber which is controllably vibrated over a preselected range of frequencies and amplitudes to attain the desired coating properties and physical characteristics. Additional control over the microspheres and the coatings desposited thereon is obtained during the electroplating process via controllably pulsing the plating solution by interrupting the egress of the plating solution from the cell chamber at a predetermined rate. Moreover, by establishing predetermined plating solution temperature/flow rate parameter combinations, coatings of various metals having uniform thicknesses and surface finishes may be formed on fusion targets heretofore unobtainable with prior art processes.

BRIEF DESCRIPTION OF THE DRAWINGS

Further objects of the invention together with additional features contributing thereto and advantages accruing therefrom will be apparent from the following description of a preferred embodiment of the invention which is shown in the accompanying drawings, which are incorporated in and form a part of the specification. In the drawings.

DETAILED DESCRIPTION OF THE INVENTION

Reference will now be made in detail to the present preferred embodiment of the invention, an example of which is illustrated in the accompanying drawings.

Figure 1:
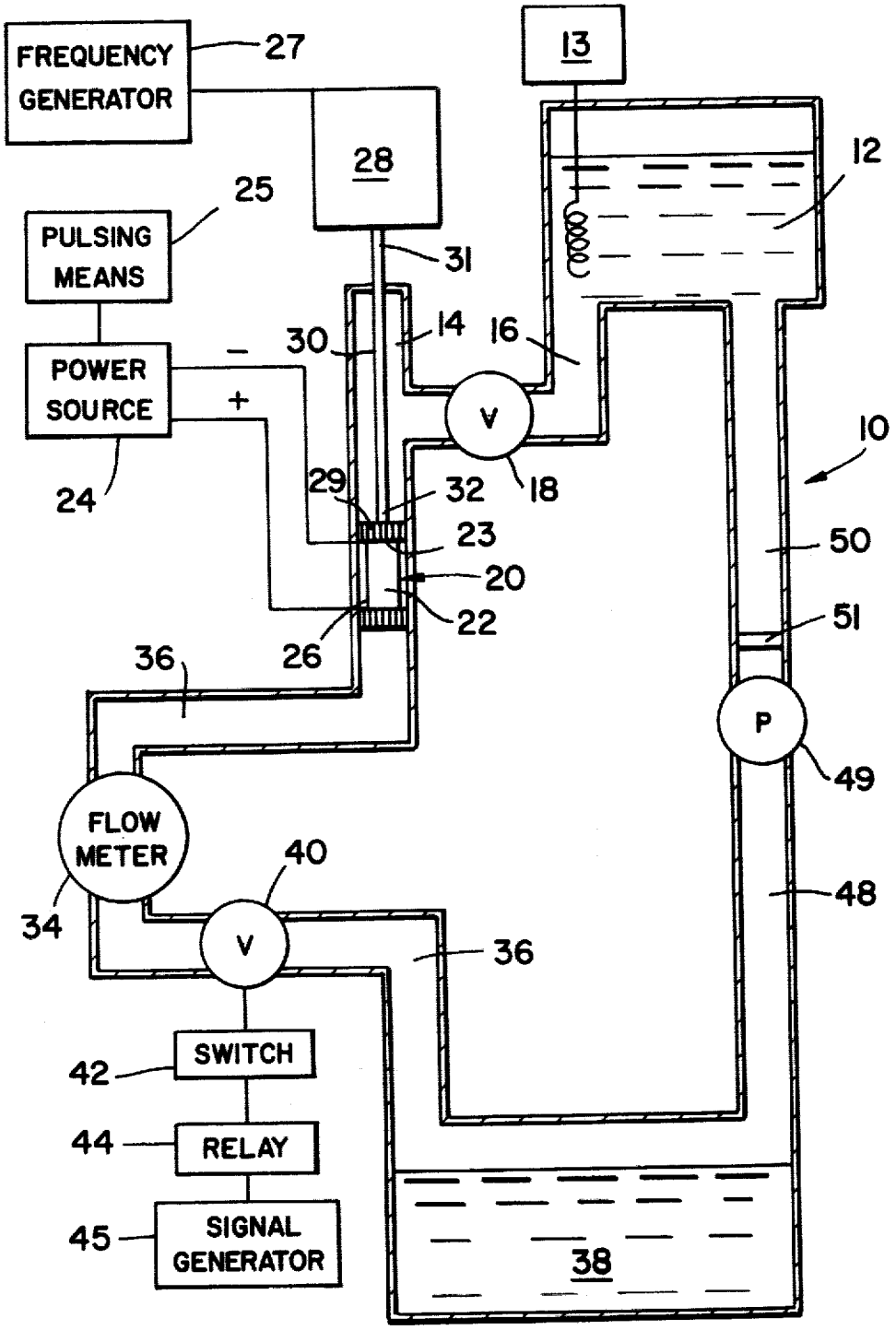
FIG. 1 is a planar schematic view of an electroplating apparatus constructed in accordance with the present invention.

Referring now to FIG. 1, an apparatus for the electroplating of particles of small dimension is shown generally by the numeral 10. The apparatus may be seen to comprise a source of plating solution or supply reservoir 12 which has means for controlling the temperature of the solution, for example, an immersion heater 13, secured thereto. The reservoir is in fluid communication with a receiving chamber or head 14 via a conduit 16 and an input control valve 18. The solution-receiving head is in fluid communication with a cathode cell 20 via a port 21 (shown in FIG. 2). The cathode cell includes a cell chamber 22 for receiving the particles and the plating solution, a cathode 23 connected to a source 24 of electrical power, and an anode 26 also connected to the power source and electrically isolated from the cathode establishing a reducing potential therebetween. The power source is preferably of the conventional type used in electroplating systems for providing a constant reducing potential and further includes pulsing means 25 for providing a controlled, pulsed reducing potential as needed.

In accordance with the present invention, means are provided for controllably vibrating the cathode 23. Preferably, the vibrating means comprises a source of vibrating motion, which, by way of example, may be seen to incude a frequency generator 27 and an electromechanical transducer 28. The vibrating means further includes a protective screen 29 (illustrated more clearly in FIG. 2) positioned adjacent the cathode and adapted for registration therewith, and a rod 30 having a first end 31 secured to the transducer and a second end 32 secured to the protective screen.

The flow of plating solution in the electroplating apparatus 10 is controlled by a flow meter 34 disposed in a conduit 36 which is in fluid communication at a first end with a port 37 (shown in FIG. 2) in the cathode cell 20 and in fluid communication at a second end with a recovery reservoir 38.

In accordance with the present invention, means are provided for controllably pulsing the plating solution within the cell chamber 22. Preferably, the plating solution pulsing means is in the form of means for controllably interrupting the egress of plating solution from the cathode cell, and may be seen to include a valve 40 disposed in the conduit 36 which is sequentially opened and closed by a switch 42 controlled by a relay 44. The relay is connected to a signal generator 45 and is movable to a plurality of preselected positions in response to corresponding selected signals from the generator.

Plating solution is drawn from the recovery reservoir 38 via a conduit 48 by a return pump 49. The solution is returned to the reservoir 12 via a conduit 50 and a return filter 51 disposed therein to remove undesirable by-products of the plating process.

Figure 2:
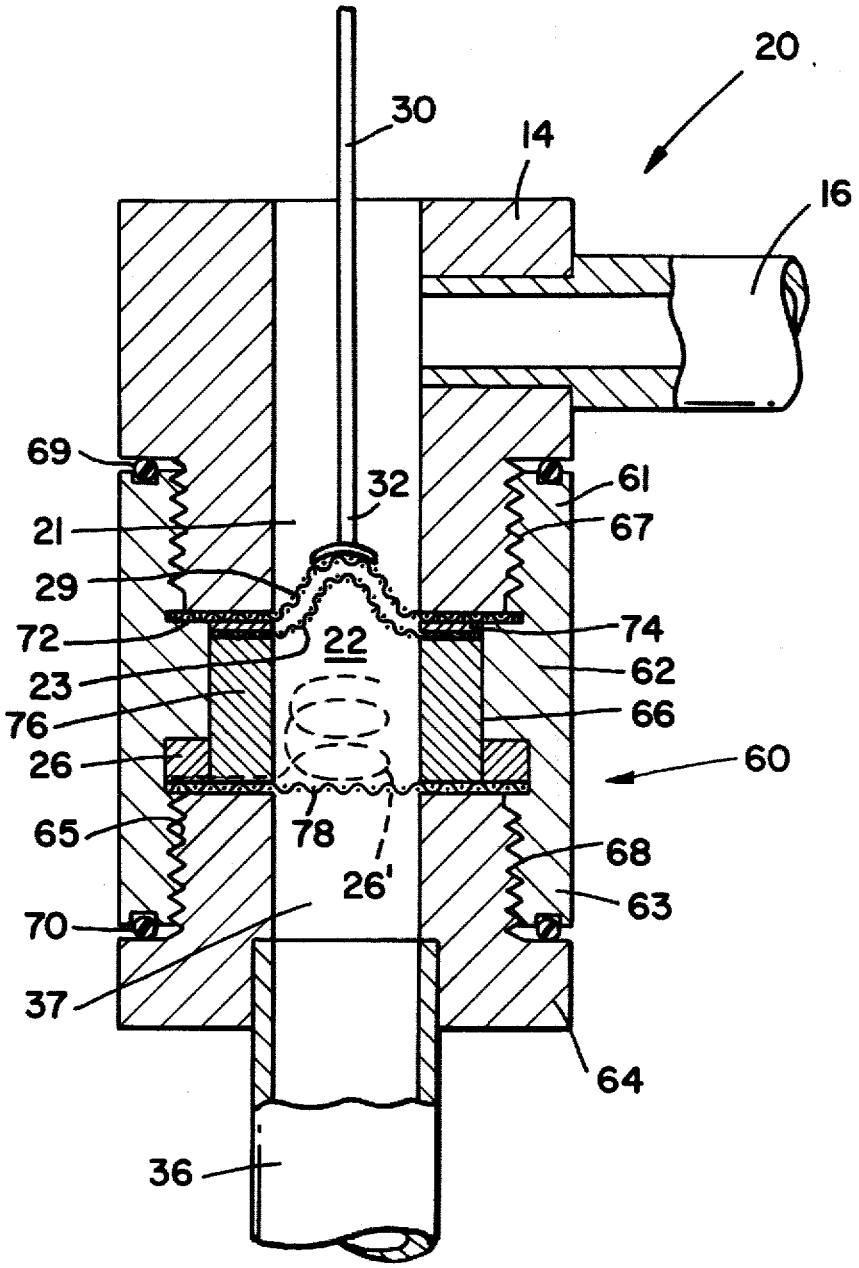
FIG. 2 is an enlarged sectional view of the cathode cell of the electroplating apparatus shown in FIG. 1.

Referring now to FIG. 2, the cathode cell 20 of the instant invention is illustrated in greater detail. The cell comprises a cylinder or body 60 having a top portion 61, a middle portion 62, a bottom portion 63 and a base 64. An open bore 65 extends coaxially through the body. A radially inwardly extending land 66 is positioned in the bore intermediate the end portions of the body.

The top and bottom body portions 61,63 are threadably coupled at 67 and 68 to the head 14 and the base 64 respectively for convenient insertion and removal of the microspheres. O-ring seals 69, 70 are disposed intermediate the head 14 and the base 64 and the respective portions of the cylinder secured thereto to prevent leakage of plating solution from the cathode cell 20.

As hereinbefore described, the protective screen 29 is positioned adjacent the cathode 23 for imparting vibrational movement thereto. The protective screen is secured intermediate the head 14 and a shoulder portion 72 of the land 66. The protective screen and the cathode are in a stacked relationship with one another; the cathode being separated from the screen by an annular spacer or washer 74.

As illustrated in the preferred embodiment, the cathode 23 comprises a resilient wire screen having a mesh size finer than the size of the microspheres. While not essential to the operation thereof, the wire screen is preferably dome shaped to impart a spring effect thereto, which permits the cathode to return to its undeformed position in response to upward motion of the vibrating means. The cathode 23 is seated on a cylindrical non-conductive sleeve 76 disposed in the body 60 in coaxial alignment with the port 37. The sleeve physically isolates the cathode and the anode 26 to prevent build up of anode sludge, the by-products of the reaction, which inhibit the reaction. The sleeve is advantageously formed from a porous ceramic material; however, any machineable, non-conductive plastic material may also be used.

In accordance with the present invention, means for collecting the microparticles are provided, preferably in the form of a screen 78 having a mesh size smaller than the size of the target spheres being plated. The collecting screen is disposed intermediate the base 64 and the sleeve 76, and cooperates with the cathode in defining the upper and lower limits of the cell chamber 22 wherein the electrolysis reaction occurs.

In the preferred embodiment illustrated, the anode 26 comprises an annular ring extending circumferentially around the cell chamber 22. It is to be understood; however, that the anode configuration is not limited thereto and may, for example, comprise a wire element 26' suspended in the chamber, as illustrated in phantom in FIG. 2.

In the operation of the present invention as taught by the above detailed description, the desired amount of material to be electroplated is deposited in the disassembled cell chamber 22. With the parts reassembled as set forth above, the proper operational parameters are selected. These parameters depend in some degree upon the plating material and include: plating solution flow rate, temperature, and pulse rate, the electroplating voltage and current wave forms, and the cathode vibration frequency. More specifically, to gold plate microspheres from sulphite gold solutions we find that a voltage of 3.5 volts, a current of 4 to 8 milliamperes and an average solution flow of 25 cc/minute yields acceptable results. Pulse plating is not an improvement for gold plated from sulphite solutions. Copper plated from pyrophasphate solutions is deposited with a dc pulsed current. A 4.5 volt 1.0 millisecond long pulse is repeated every 4 milliseconds. The current drawn from the pulsed source is 30 up to 120 milliamperes. Both the above mentioned copper and gold plating baths can be operated at room temperature although there are beneficial effects to operating the copper baths at 45° C.

The plating solution is initially flowed down the cell 20. Buoyancy pulls the microspheres up towards the cathode 23 so the plating process can occur. As these spheres are coated, they become heavy and sink, so the flow of the plating solution is then reversed which maintains contact between the particles and the cathode. When the desired coating thickness is attained, the microspheres are collected from the collecting screen 78.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without department from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. In an apparatus (10) electroplating particles of small dimension where the difference between the density of the particles and the plating solution is large or the mass of the particles is very small, the apparatus (10) including a source (12) of plating solution, and a source (24) of electrical power, the improvement comprising:

a cathode cell (20) having a cell chamber (22) for receiving the particles to be plated and the plating solution;

a cathode (23) connected to the power source (24) and comprising a resilient wire screen having a dome-shaped section;

means (27, 28, 29, 30) for vibrating the cathode (23) to maintain the particles to be plated in random free motion and including means positioned adjacent to and adopted for registration with said dome-shaped section of said cathode; and an anode (26) connected to the power source (24) and electrically isolated from the cathode (23) establishing a reducing potential therebetween.

2. The apparatus (10) of claim 1 including means (78) for collecting the particles in the cell chamber (22).

3. The apparatus (10) of claim 1 wherein the particle collecting means (78) comprises a screen (78) having a preselected mesh size which is smaller than the size of the particles.

4. The apparatus (10) of claim 2 wherein the cell chamber (22) comprises the portion of the cathode cell (20) intermediate the cathode (23) and the particle collecting means (78).

5. The apparatus (10) of claim 1 wherein the anode (26) comprises a wire suspended in the cell chamber (22).

6. The apparatus (10) of claim 1 wherein the anode (26) comprises an annular ring (26) extending circumferentially around the cell chamber (22).

7. The apparatus (10) of claim 1 including means (24) for controllably pulsing the reducing potential between the anode (26) and the cathode (23).

8. The apparatus (10) of claim 1 wherein the vibrating means (27,28,29,30) comprises:

a source (27,28) of vibrating motion;

a protective screen (29) positioned adjacent the cathode (23) and adapted for registration therewith; and a rod (30) extending between the source (27,28) of vibrating motion and the protective screen (29), the rod (30) having a first end (31) secured to the source (28) and a second end (32) secured to the screen (29).

9. The apparatus (10) of claim 1 including means (40,42,44,45) for controllably pulsing the plating solution within the cell chamber (22).

10. The apparatus (10) of claim 9 wherein the plating solution pulsing means (40,42,44,45) comprises means (40,42,44,45) for controllably interrupting egress of plating solution from the cathode cell (20).

11. The apparatus (10) of claim 10 wherein the interrupting means (40,42,44,45) includes a valve (40), a signal generator (45), a relay (44) connected to the signal generator (45) and movable to a plurality of preselected positions in response to signals from the generator (45), and switch means (42) connected to the relay (44) for opening and closing valve (40) in response to movement of the relay (44).

12. A vibrating cathode cell (20) for electroplating particles of small dimension where the difference between the density of the particles and the plating solution is large or the mass of the particles is very small, comprising:

a cell chamber (22) adapted to receive the plating solution and the particles to be plated;

a cathode (23) having a dome-shaped section connected to a source (24) of electrical power:

means (27, 28, 29,30) for vibrating the cathode (23) to maintain the particles to be plated in random free motion and comprising a source (27, 28) of vibrating motion, a protective screen (29) positioned adjacent to the dome-shaped section of the cathode (23) and adapted for registration therewith, and a rod (30) extending between the source (27, 28) of vibrating motion and the protective screen (29), the rod (30) having a first end (31) secured to the source (28) and a second end (32) secured to the screen (29); and an anode (26) connected to the power source (24) and electrically isolated from the cathode (23) establishing a reducing potential therebetween.

13. The cathode cell (20) of claim 12 including means (78) for collecting the particles in the cell chamber (22).

14. The cathode cell (20) of claim 13 wherein the particle collecting means (78) comprises a screen (78) having a preselected mesh size which is smaller than the size of the particles.

15. The cathode cell (20) of claim 13 wherein the cell chamber (22) comprises the portion of the cathode cell (20) intermediate the cathode (23) and the particle collecting means (78).

16. The cathode cell (20) of claim 12 wherein the cathode (23) comprises a resilient wire screen (23).

17. The cathode cell (20) of claim 12 wherein the anode (26) comprises a wire suspended in the cell chamber (22).

18. The cathode cell (20) of claim 12 wherein the anode (26) comprises an annular ring (26) extending circumferentially around the cell chamber (22).

19. The cathode cell (20) of claim 12 including means (24) for controllably pulsing the reducing potential between the anode (26) and the cathode (23).

20. The cathode cell (20) of claim 12 including means (40,42,44,45) for controllably pulsing the plating solution within the cell chamber (22).

21. The cathode cell (20) of claim 20 wherein the plating solution pulsing means (40,42,44,45) comprises means (40,42,44,45) for controllably interrupting egress of plating solution from the cathode cell (20).

22. The cathode cell (20) of claim 21 wherein the interrupting means (40,42,44,45) includes a valve (40) a signal generator (45) a relay (44) connected to the signal generator (45) and movable to a plurality of preselected positions in response to signals from the generator (45) and switch means (42) connected to the relay (44) for opening and closing the valve (40) in response to movement of the relay (44).

* * * * *